US011892263B2

(12) United States Patent
Kung et al.

(10) Patent No.: US 11,892,263 B2
(45) Date of Patent: Feb. 6, 2024

(54) SIMULATED SHAKING BULLET CHAIN STRUCTURE OF TOY GUN

(71) Applicant: VEGA FORCE INTERNATIONAL CORP., Taoyuan (TW)

(72) Inventors: Shih-Che Kung, Taoyuan (TW); Wei-Hung Chung, Taoyuan (TW)

(73) Assignee: VEGA FORCE INTERNATIONAL CORP., Taoyuan (TW)

( * ) Notice: Subject to any disclaimer, the term of this patent is extended or adjusted under 35 U.S.C. 154(b) by 176 days.

(21) Appl. No.: 17/725,264

(22) Filed: Apr. 20, 2022

(65) Prior Publication Data

US 2023/0266092 A1 Aug. 24, 2023

(51) Int. Cl.

| | |
|---|---|
| ***F41B 7/08*** | (2006.01) |
| ***F41A 33/00*** | (2006.01) |
| ***A63H 33/30*** | (2006.01) |
| ***A63H 33/00*** | (2006.01) |

(52) U.S. Cl.

CPC ..... *F41A 33/00* (2013.01); *A63H 33/009* (2013.01); *A63H 33/30* (2013.01); *F41B 7/08* (2013.01)

(58) Field of Classification Search

CPC ..... A63H 33/009; A63H 5/04; F41B 7/08

See application file for complete search history.

(56) References Cited

U.S. PATENT DOCUMENTS

| | | | | |
|---|---|---|---|---|
| 3,369,535 | A * | 2/1968 | Bonanno | F41B 7/006 124/31 |
| 4,696,654 | A * | 9/1987 | Welch | A63H 5/04 446/268 |
| 5,660,159 | A * | 8/1997 | Clayton | F41B 11/646 124/66 |
| 6,695,676 | B2 * | 2/2004 | Blake | A63H 5/04 446/475 |
| 8,082,909 | B2 * | 12/2011 | Sopinsky | F41B 7/08 124/16 |
| 8,800,541 | B2 * | 8/2014 | Hu | F41A 33/06 124/66 |
| 10,989,493 | B1 * | 4/2021 | Kung | F41A 33/06 |
| 2009/0151710 | A1 * | 6/2009 | Zimmerman | F41B 11/89 124/1 |

* cited by examiner

*Primary Examiner* — John A Ricci

(74) *Attorney, Agent, or Firm* — Chun-Ming Shih; HDLS IPR SERVICES

(57) ABSTRACT

A shaking bullet chain structure of a toy gun is provided. The toy gun has a gun body and an action. The structure includes a fixing base, a slider, a bullet chain, and a sway assembly. The fixing base is disposed beside the gun body and includes a frame and a cover. The slider is movably connected to the cover and is provided with a working trough. The bullet chain is hung on the fixing base and includes multiple bullets and a belt. One end of the sway assembly is pivoted to the frame, and another end is connected to an insert rod. The insert rod penetrates a bullet and the working trough. When the action reciprocates in the gun body, the action is configured to drives the slider to move therewith to further drive the bullet chain to shake by the working trough pushing the insert rod.

10 Claims, 8 Drawing Sheets

SIMULATED SHAKING BULLET CHAIN STRUCTURE OF TOY GUN

BACKGROUND

Technical Field

The disclosure relates to a toy gun, particularly to a simulated shaking bullet chain structure of a toy gun.

Related Art

With the development of divergent life styles, some people choose recreational activities to release the stress that has accumulated. Some people pursue recreational activities that are both fresh and exciting, so that toy guns such as airsoft guns, paintball guns and air guns have become one of hot recreational activities.

An airsoft pellet or paintball used by a related-art toy gun is a spherical body and hidden in a magazine. It is quite different from the actual jungle or street fighting, so as to greatly reduce the immersive visual experience and shocking effect of the contestants.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

SUMMARY

An object of the disclosure is to provide a simulated shaking bullet chain structure of a toy gun, which uses a sway assembly to shake a bullet chain to generate a visual effect of a real gun when shooting.

To accomplish the above object, the disclosure provides a shaking bullet chain structure of a toy gun. The toy gun has a gun body and an action. The structure includes a fixing base, a slider, a bullet chain, and a sway assembly. The fixing base is disposed beside the gun body and includes a frame and a cover. The slider is movably connected to the cover and is provided with a working trough. The bullet chain is hung on the fixing base and includes multiple bullets and a belt connected with the bullets. One end of the sway assembly is pivoted to the frame, and another end of the sway assembly is connected to an insert rod. The insert rod penetrates one of the bullets and the working trough. When the action reciprocates in the gun body, the action is configured to drives the slider to move therewith to further drive the bullet chain to shake by the working trough pushing the insert rod.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
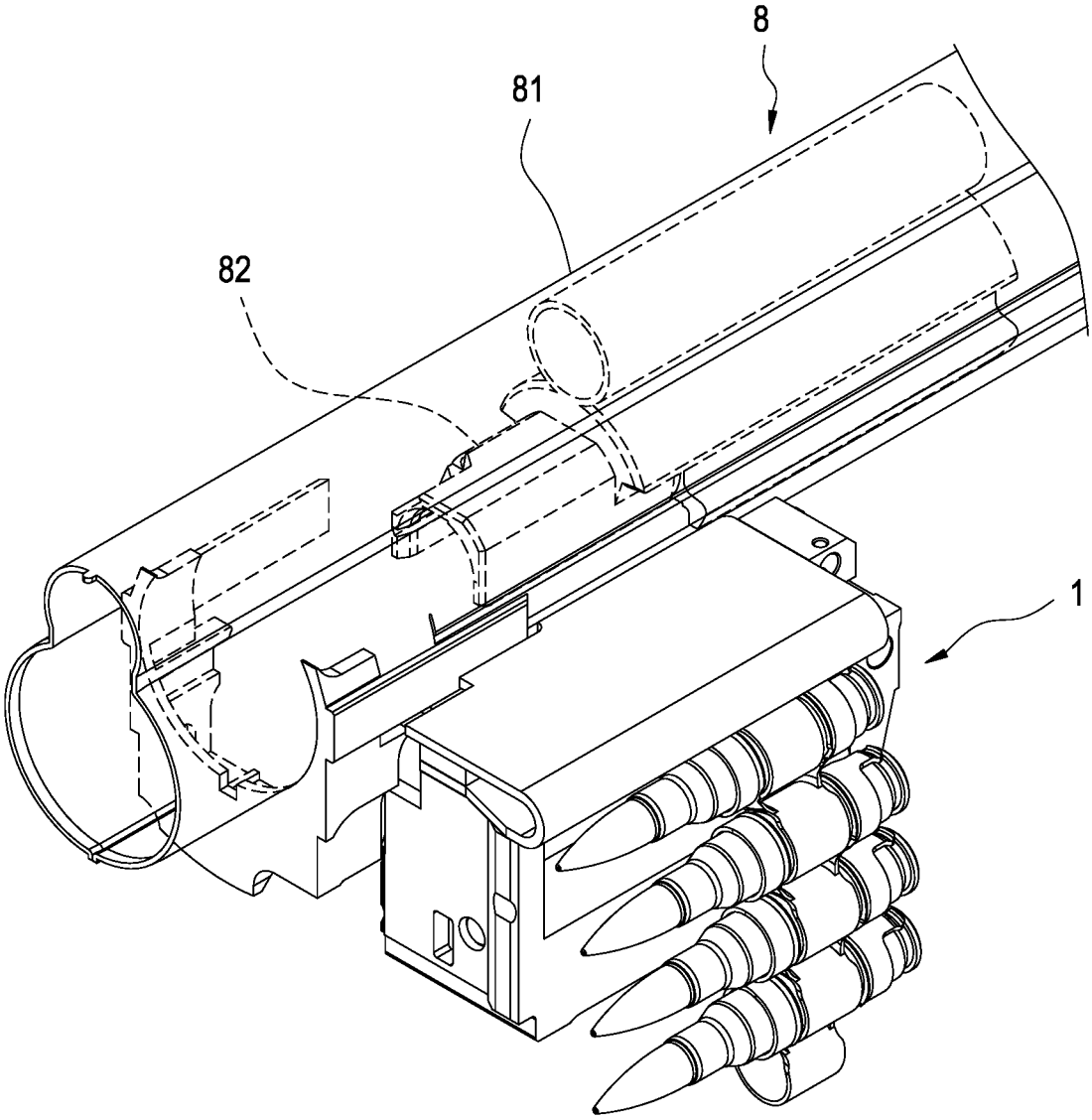
FIG. 1 is a perspective view of the simulated shaking bullet chain structure of the disclosure assembled to a toy gun
Figure 2:
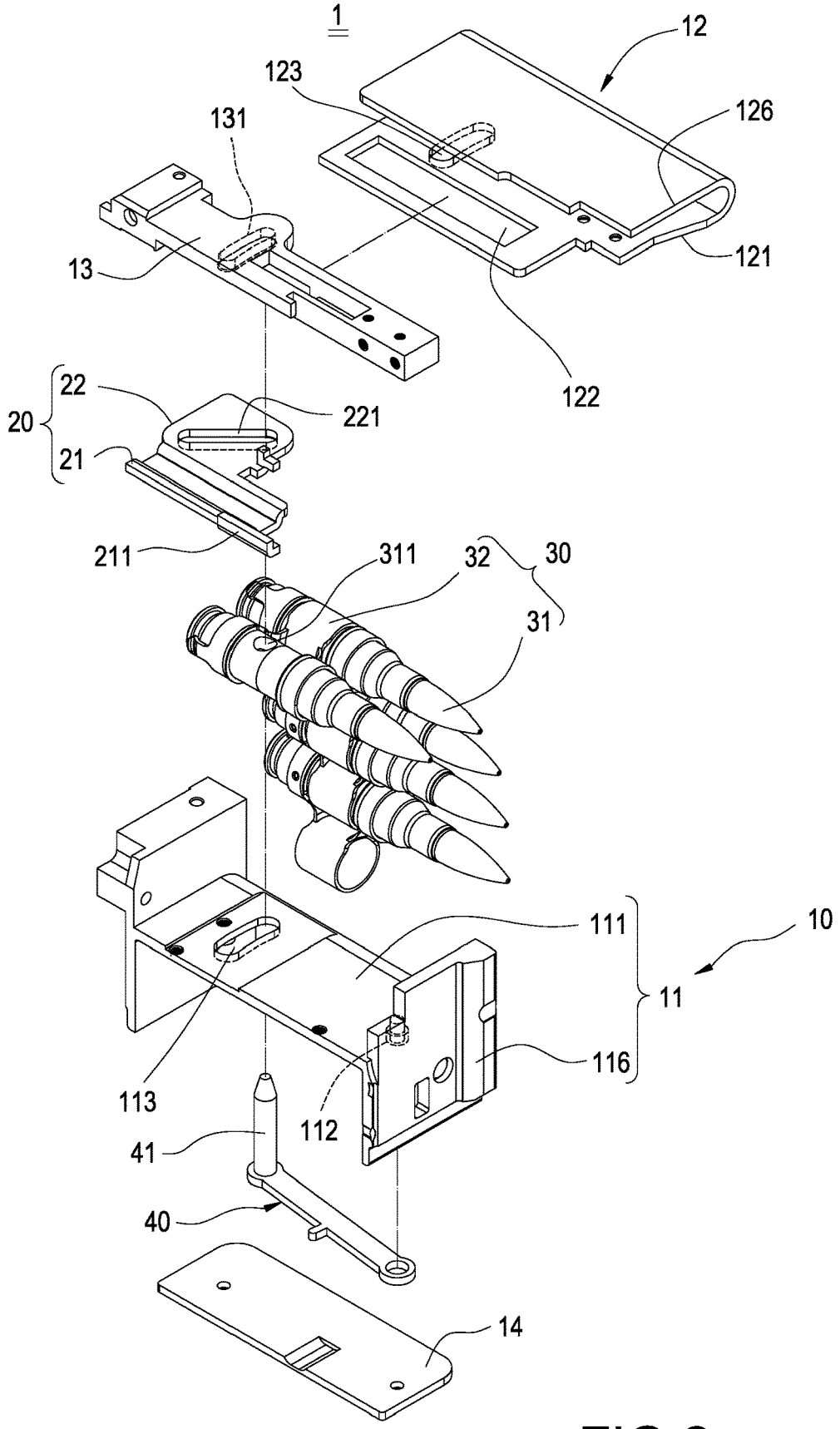
FIG. 2 is an exploded view of the simulated shaking bullet chain structure of the disclosure.
Figure 3:
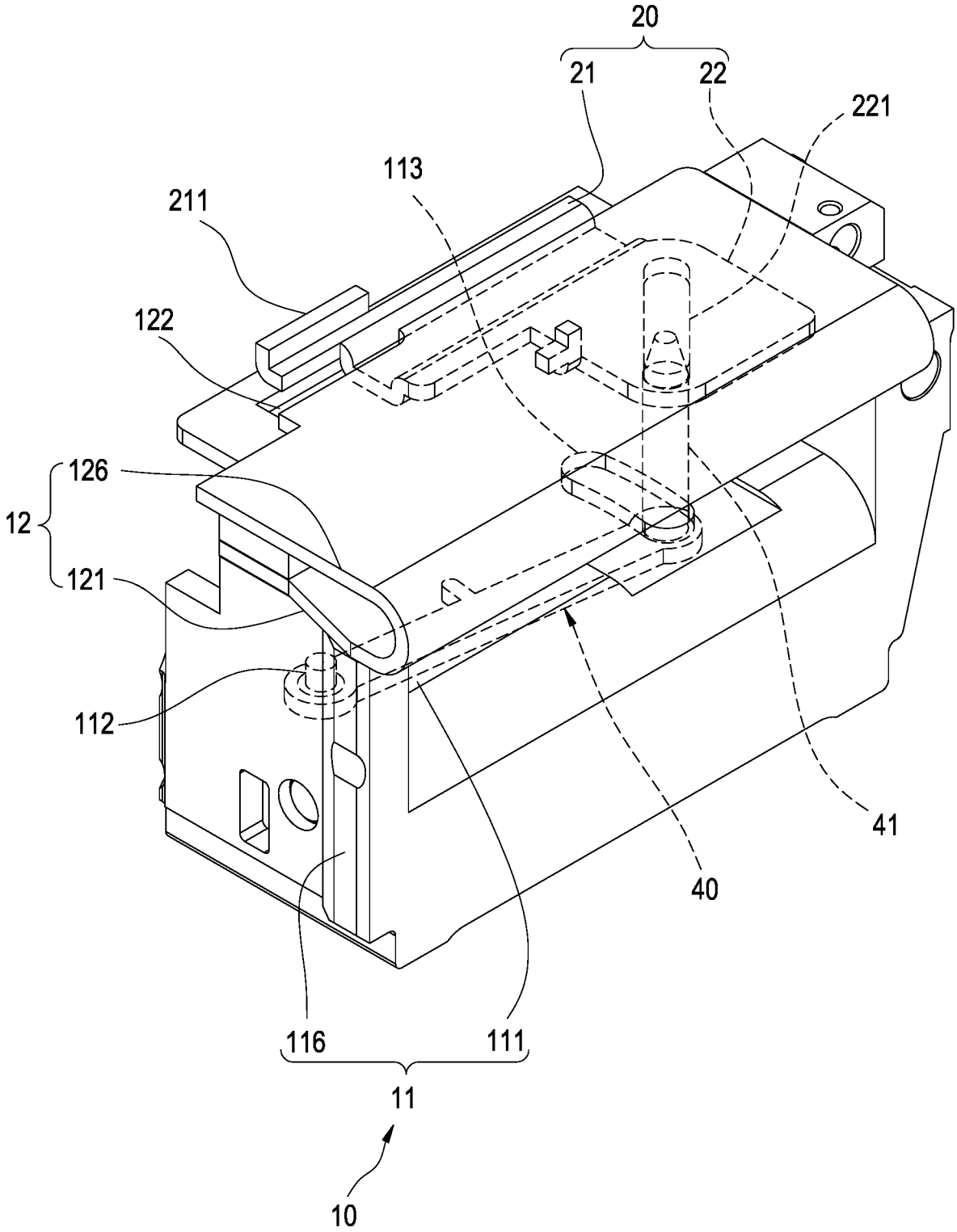
FIG. 3 is a schematic view of the simulated shaking bullet chain structure of the disclosure.
Figure 4:
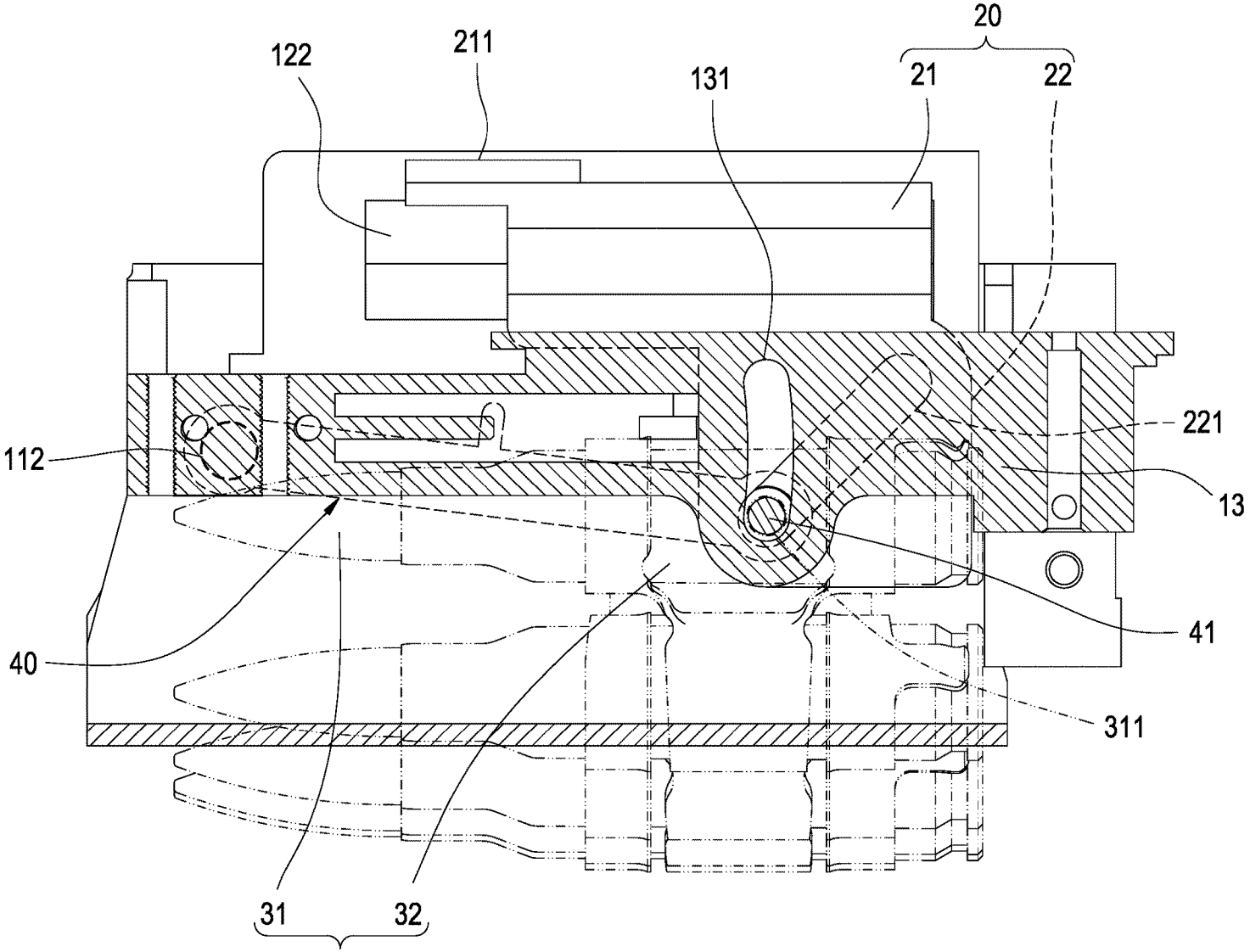
FIG. 4 is a cross-sectional view of the simulated shaking bullet chain structure of the disclosure.
Figure 5:
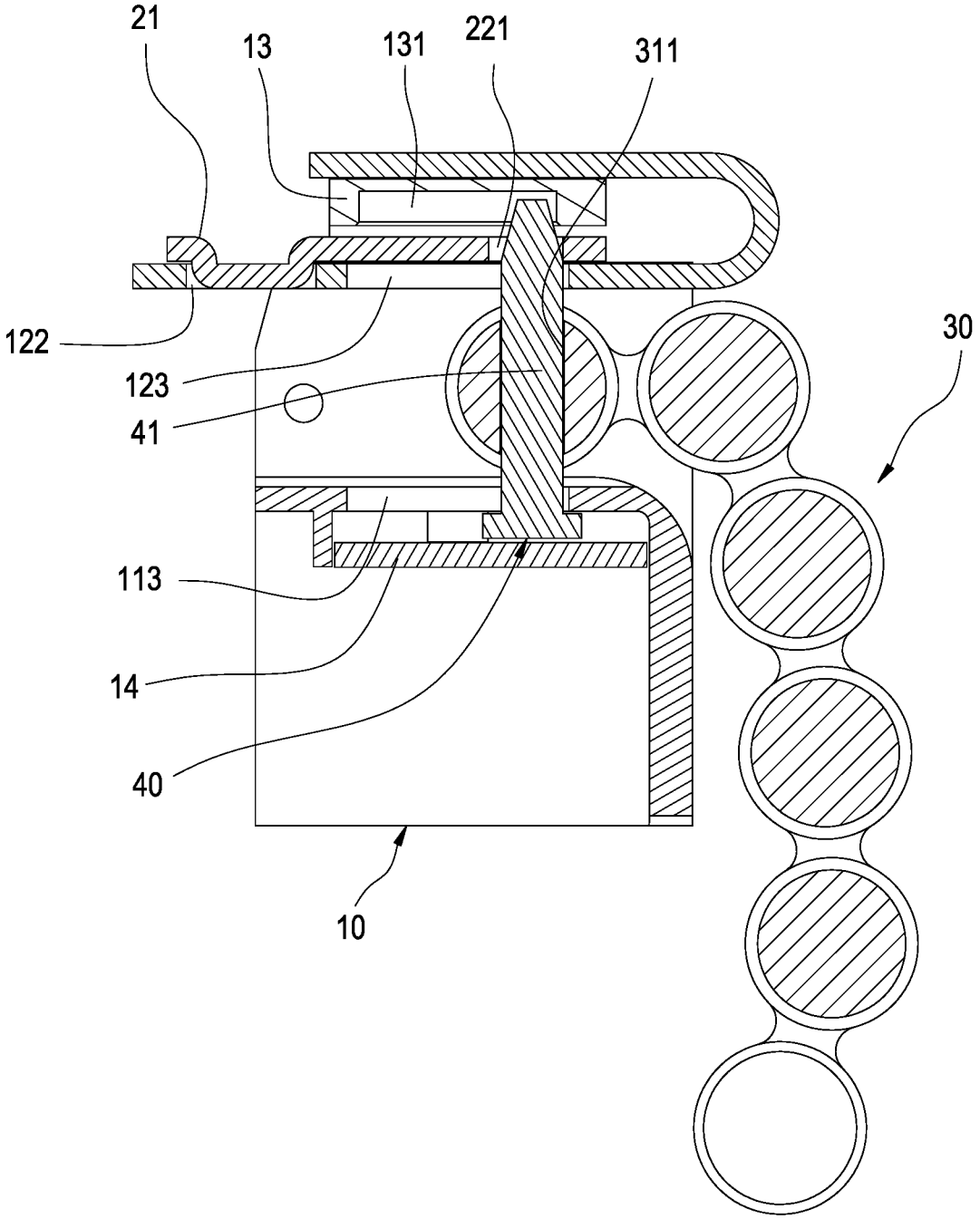
FIG. 5 is another cross-sectional view of the simulated shaking bullet chain structure of the disclosure in another direction.

Please refer to FIGS. 1-5. The disclosure provides a shaking bullet chain structure of a toy gun. The toy gun 8 has a gun body 81, an action 82 and other related components. The gun body 81 has a bore and is connected with related components such as a trigger assembly, a barrel, and a sight. The action 82 is movably accommodated in the bore of the gun body 81. Detail of the aforementioned components is omitted here for brevity.

The shaking bullet chain structure 1 of the disclosure includes a fixing base 10, a slider 20, a bullet chain 30 and a sway assembly 40.

The fixing base 10 is disposed beside the gun body 81 and includes a frame 11 and a cover 12. The frame 11 is of a substantial H-shape and includes a transverse plate 111 and two longitudinal plates 116 which are separately connected to two ends of the transverse plate 111. An end of the transverse plate 111, which is adjacent to one of the longitudinal plates 116, is connected with a shaft 112, and the other end of the transverse plate 111, which is away from the abovementioned longitudinal plate 116, is formed with a lower guiding trough 113. The lower guiding trough 113 is an arcuate through trough.

The cover 12 covers and is connected to the frame 11. The cover 12 is of a substantial U-shape and includes a lower plate 121 and an upper plate 126. The lower plate 121 is formed with a strip-shaped trough 122. An upper guiding trough 123 is formed on a side of the strip-shaped trough 122 of the lower plate 121 and is an arcuate through trough.

In one embodiment, the fixing base 10 further includes a pressing plate 13 which is arranged correspondingly to the strip-shaped trough 122 and received in the cover 12. The pressing plate 13 is formed with a limiting trough 131 at a position corresponding to the upper guiding trough 123. The limiting trough 131 is an arcuate blind trough.

In one embodiment, the fixing base 10 further includes a baseplate 14 which is disposed under the transverse plate 111.

The slider 20 is movably connected to the cover 12 and includes a sliding rail 21 and an extending plate 22 protruding from the sliding rail 21. A side of the sliding rail 21 is disposed with a driven block 211. A middle position of the extending plate 22 is formed with a working trough 221. In the embodiment, the working trough 221 is a slant trough, and the working trough 221 is arranged to cross the lower guiding trough 113, the upper guiding trough 123 and the limiting trough 131. The slider 20 is disposed between the lower plate 121 and the pressing plate 13. The sliding rail 21 straddles the strip-shaped trough 122 and is able to move relative to the strip-shaped trough 122. The working trough 221 is arranged corresponding to the lower guiding trough 113, the upper guiding trough 123 and the limiting trough 131.

The bullet chain 30 is hung on a side of the fixing base 10 and includes multiple bullets 31 and a belt 32. Each bullet 31 is aligned and connected through the belt 32. The first bullet 31 is formed with an opening 311. The bullets 31 mentioned in the specification may be any items which are applied to a toy gun, such as simulated bullets or other fake bullets.

One end of the sway assembly 40 is pivoted to the shaft 112 of the frame 11, and the other end of the sway assembly 40 is connected to an insert rod 41. The insert rod 41 penetrates the lower guiding trough 113, the opening 311 of the bullet 31, the upper guiding trough 123, the working trough 221 and the limiting trough 131 in order.

Figure 6:
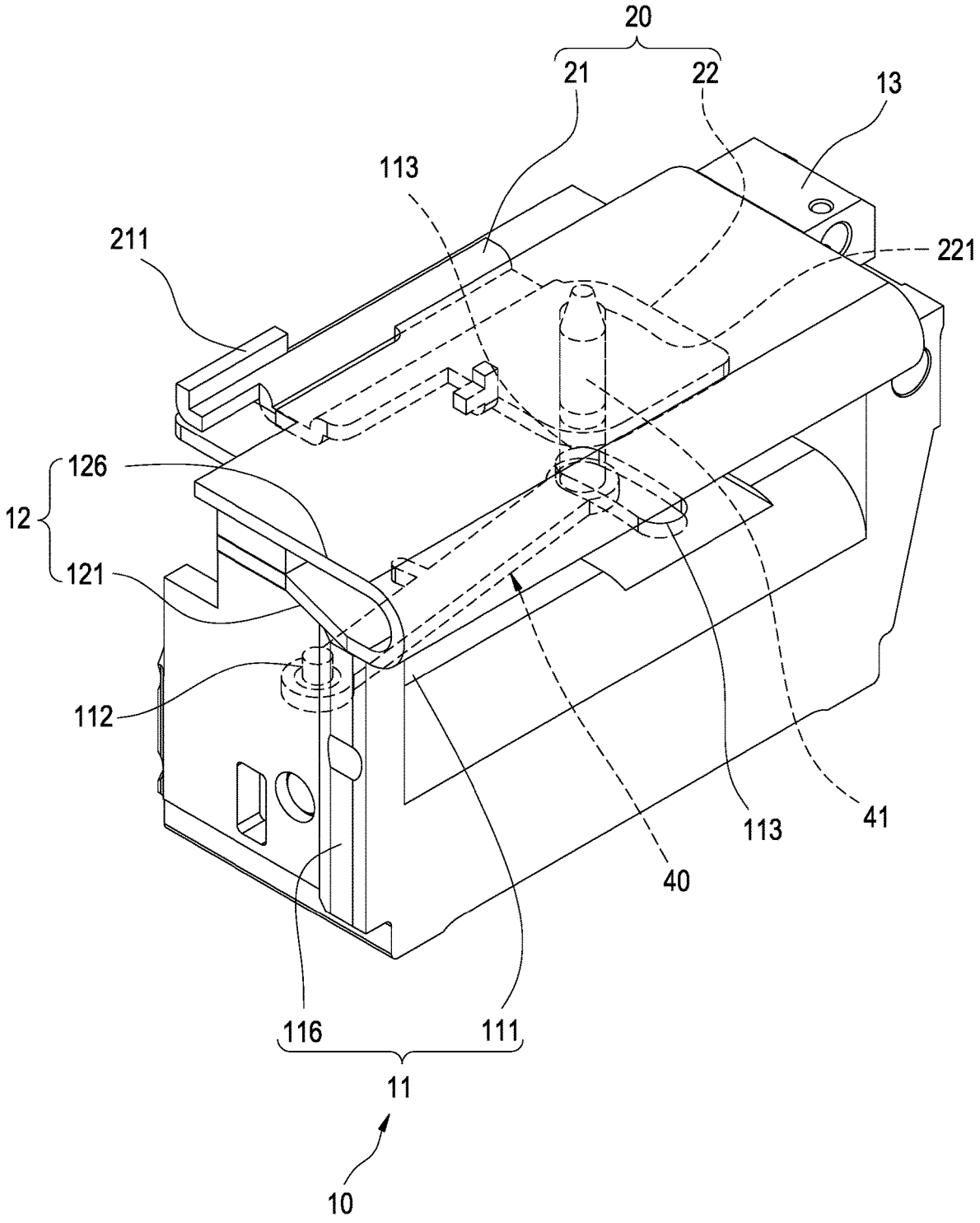
FIG. 6 is a schematic view of the simulated shaking bullet chain structure of the disclosure in the using status.
Figure 7:
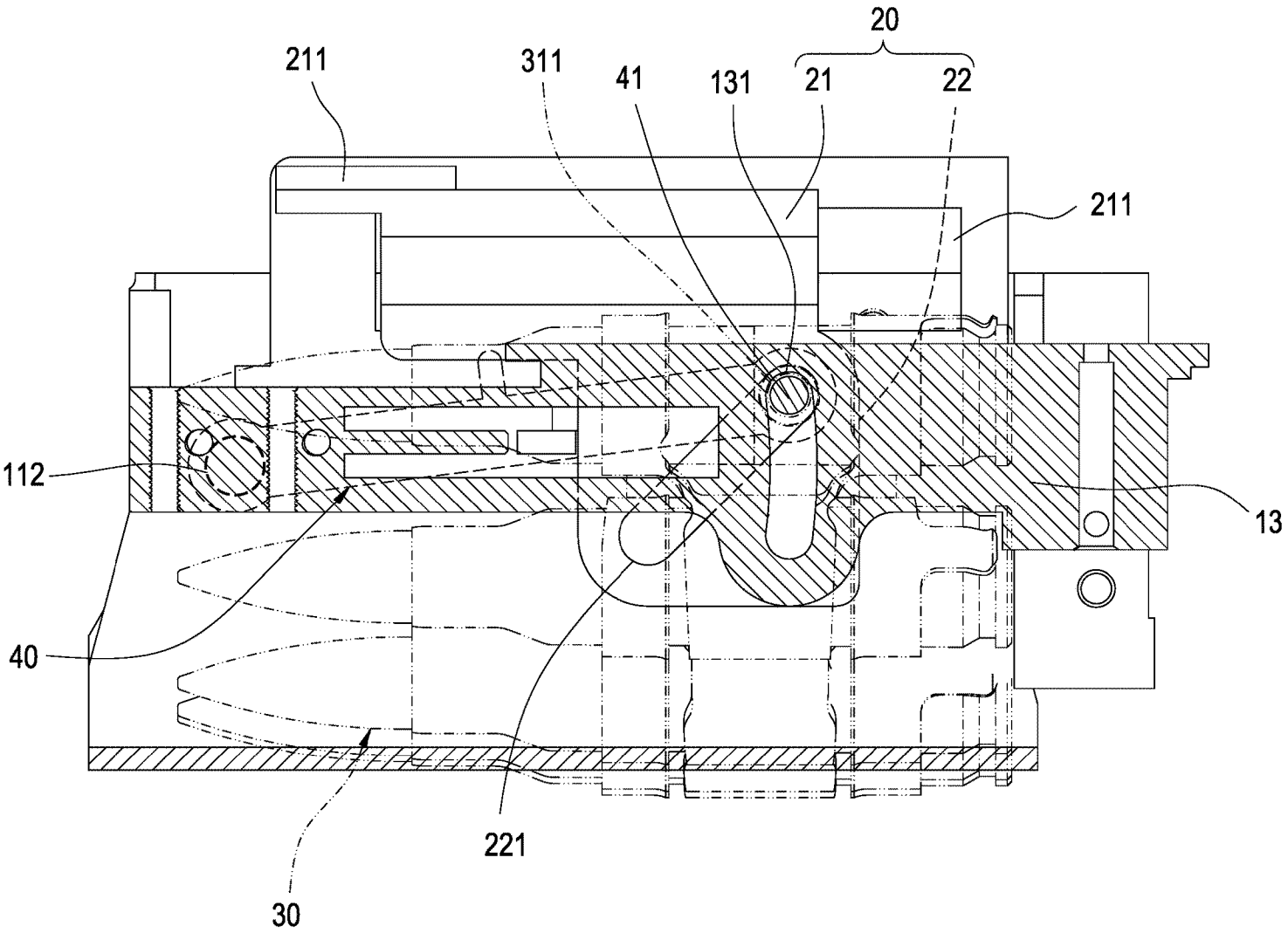
FIGS. 7 and 8 are cross-sectional views of the simulated shaking bullet chain structure of the disclosure in the using status.
Figure 8:
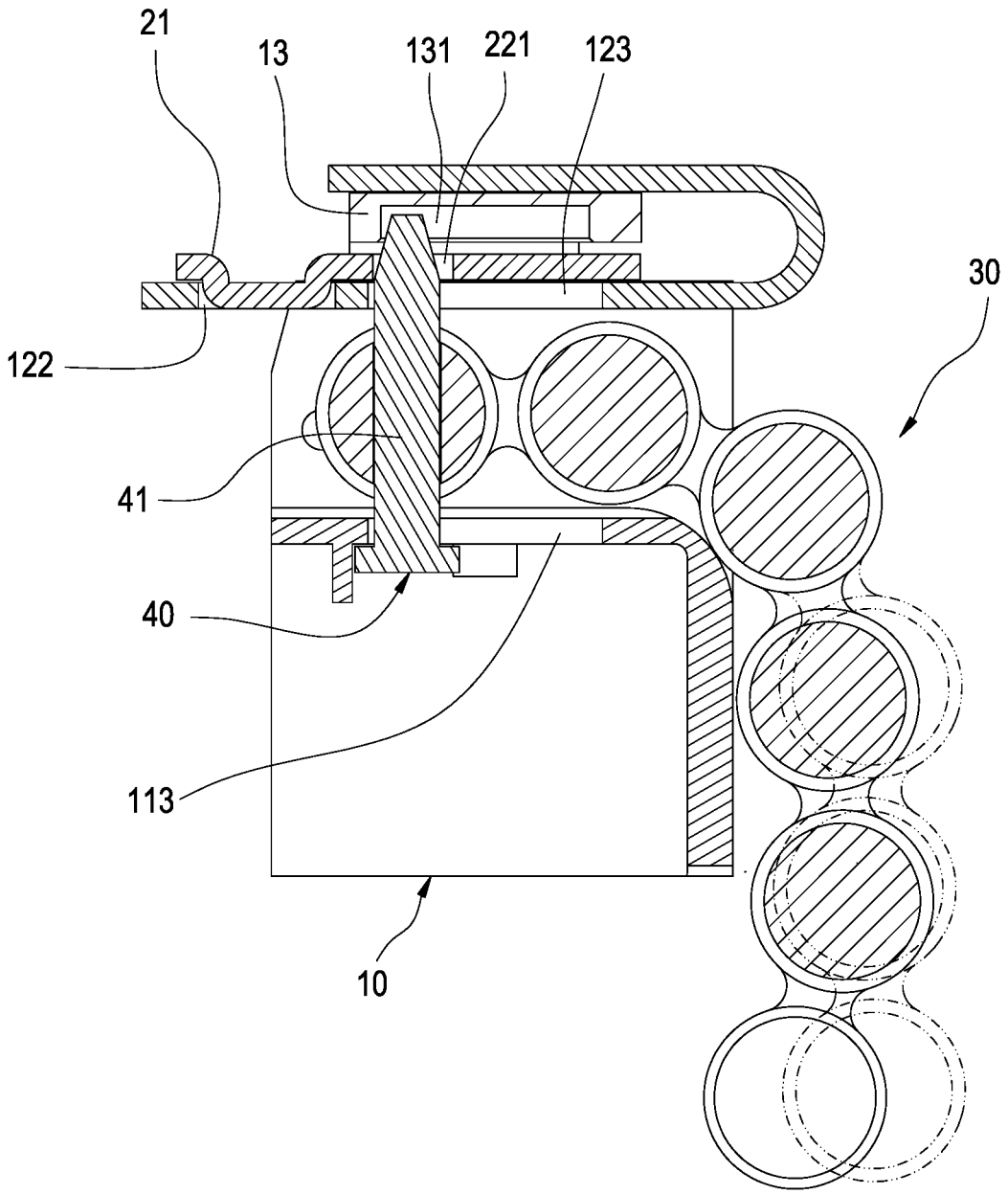

Please refer to FIGS. 1 and 6-8. When operating, by the action 82 reciprocating relative to the gun body 81, the action 82 pushes the driven block 211 of the slider 21 to move therewith. By the movement of the slider 21, the working trough 221 drives the insert rod 41 to rotate about the shaft 112 to rotate the sway assembly 40, and the insert rod 41 moves leftward and rightward along shapes of the upper guiding trough 123, the working trough 221 and the lower guiding trough 113 to correspondingly shake the bullet chain 30. Because each of the upper guiding trough 123 and the lower guiding trough 113 is an arcuate trough, it may achieve a better shaking effect.

While this disclosure has been described by means of specific embodiments, numerous modifications and variations could be made thereto by those skilled in the art without departing from the scope and spirit of this disclosure set forth in the claims.

What is claimed is:

1. A simulated shaking bullet chain structure of a toy gun, the toy gun comprising a gun body and an action, the simulated shaking bullet chain structure comprising:

a fixing base, disposed beside the gun body, and comprising a frame and a cover connected to the frame;

a slider, movably connected to the cover, and comprising a working trough;

a bullet chain, disposed beside the fixing base, and comprising multiple bullets and a belt connected with the bullets; and a sway assembly, one end thereof pivoted to the frame, another end thereof connected to an insert rod, and the insert rod penetrating one of the bullets and the working trough;

wherein when the action reciprocates in the gun body, the action is configured to drives the slider to move therewith to further drive the bullet chain to shake by the working trough pushing the insert rod.

2. The simulated shaking bullet chain structure of claim 1, wherein the cover comprises a lower plate, the lower plate comprises a strip-shaped trough, the slider comprises a sliding rail, and the sliding rail straddles the strip-shaped trough and is movable on the strip-shaped trough.

3. The simulated shaking bullet chain structure of claim 2, wherein the cover further comprises an upper plate disposed over the lower plate, the slider further comprises an extending plate connected to the sliding rail, and the working trough is disposed in the extending plate.

4. The simulated shaking bullet chain structure of claim 2, wherein the fixing base further comprises a pressing plate received in the cover and located over the lower plate, and the slider is disposed between the lower plate and the pressing plate.

5. The simulated shaking bullet chain structure of claim 4, wherein the frame comprises a transverse plate, the transverse plate comprises a lower guiding trough, the lower plate comprises an upper guiding trough, the pressing plate comprises a limiting trough, and the insert rod sequentially penetrates the lower guiding trough, one of the bullets, the upper guiding trough, the working trough, and the limiting trough.

6. The simulated shaking bullet chain structure of claim 5, wherein the working trough is a slant trough, each of the upper guiding trough and the lower guiding trough is an arcuate through trough, and each arcuate through trough is arranged to cross the slant trough.

7. The simulated shaking bullet chain structure of claim 2, wherein the sliding rail comprises a driven block disposed on a side thereof, and the driven block is activated by the action.

8. The simulated shaking bullet chain structure of claim 1, wherein the frame comprises a transverse plate connected with a shaft, and the sway assembly is pivotally connected to the shaft.

9. The simulated shaking bullet chain structure of claim 8, wherein the frame further comprises two longitudinal plates separately connected to two ends of the transverse plate, and the cover covers between the longitudinal plates.

10. The simulated shaking bullet chain structure of claim 1, wherein the frame is of an H-shape, and the cover is of a U-shape.

* * * * *